US007938065B2

(12) United States Patent
Desai

(10) Patent No.: US 7,938,065 B2
(45) Date of Patent: May 10, 2011

(54) EFFICIENT EXPLODING FOIL INITIATOR AND PROCESS FOR MAKING SAME

(76) Inventor: Amish Desai, Altadena, CA (US)

( * ) Notice: Subject to any disclaimer, the term of this patent is extended or adjusted under 35 U.S.C. 154(b) by 599 days.

(21) Appl. No.: 12/002,195

(22) Filed: Dec. 14, 2007

(65) Prior Publication Data

US 2009/0151584 A1 Jun. 18, 2009

(51) Int. Cl.
*F23Q 7/02* (2006.01)

(52) U.S. Cl. ..... 102/202.5; 102/202.7

(58) Field of Classification Search ..... 102/202.5, 102/202.7, 202.9, 206
See application file for complete search history.

(56) References Cited

U.S. PATENT DOCUMENTS

| | | | | |
|---|---|---|---|---|
| 4,862,803 | A * | 9/1989 | Nerheim et al. | 102/202.5 |
| 4,944,225 | A * | 7/1990 | Barker | 102/202.5 |
| 5,291,828 | A * | 3/1994 | Nerheim et al. | 102/202 |
| 5,731,538 | A * | 3/1998 | O'Brien et al. | 102/202.5 |
| 5,756,925 | A * | 5/1998 | Frank et al. | 102/202.7 |
| 6,234,081 | B1 | 5/2001 | Neyer | |

* cited by examiner

*Primary Examiner* — J. Woodrow Eldred

(57) ABSTRACT

An actuator assembly that includes, in one example embodiment, a substrate with a bridge coupled between a first electrode and a second electrode on the substrate. A lithographically disposed flyer is positioned in proximity to the bridge. In a more specific embodiment, the actuator assembly further includes a lithographically disposed barrel that partially surrounds the flyer. A fireset is coupled to pins that extend through the substrate to the first electrode and the second electrode. The flyer further includes a three-dimensional surface adapted to flatten during flight. The flyer may be concave, convex, or may star shaped, may have perforations therein, or may exhibit another shape or other features.

23 Claims, 6 Drawing Sheets

EFFICIENT EXPLODING FOIL INITIATOR AND PROCESS FOR MAKING SAME

ACKNOWLEDGEMENT OF GOVERNMENT SUPPORT

This invention was made with Government support under Contract No. W15QKN-04-C-1130 awarded by US ARMY TACOM-ARDEC. The Government has certain rights to this invention.

CROSS-REFERENCE TO RELATED APPLICATIONS

This application is related to co-pending U.S. patent application Ser. No. 60/772,180 filed on May 7, 2007, entitled MULTILAYERED MICROCAVITIES AND ACTUATORS INCORPORATING SAME, which is hereby incorporated by reference as if set forth in full in this application.

This application is related to U.S. Pat. No. 7,021,217, issued Apr. 4, 2006, entitled VERSATILE CAVITY ACTUATOR AND SYSTEMS INCORPORATING SAME, which is hereby incorporated by reference as if set forth in full in this application.

BACKGROUND OF THE INVENTION

1. Field of Invention

This invention relates to actuators. Specifically, the present invention relates to devices and components thereof for selectively initiating an action and further relates to methods for making such devices and components.

2. Description of the Related Art

Initiators are employed in various demanding applications, including airbag activation, munitions detonation, solid rocket motor ignition, aircraft pilot ejection, and so on. Such applications often require relatively safe initiators that do not activate unless a predetermined set of conditions are met.

Safe initiators are particularly important in munitions applications, where inadvertent activation of an explosive charge can be devastating. For the purposes of the present discussion, an initiator may be any device or module that initiates or starts an action in response to a predetermined signal or sensed condition. An actuator may be anything that causes or performs an action when activated. Munitions that are equipped with relatively safe initiators are often called insensitive munitions. Ideally, insensitive munitions will not explode, even in a fire, unless desired conditions are met.

Insensitive munitions are often equipped with Exploding Foil Initiators (EFIs). An example EFI includes a silicon substrate with an exploding foil, often called a bridge, coupled between two electrodes, called lands. A flyer is positioned on the bridge and near an explosive charge. A barrel may act as a spacer between the foil and the explosive charge. A fireset is coupled to the electrodes. When certain desired conditions are met, the fireset applies a high voltage pulse to the electrodes sufficient to explode the foil. The exploding foil propels the flyer into the explosive charge at sufficiently high velocities to detonate the explosive charge.

Unfortunately, conventional EFIs are often bulky, inefficient, and expensive. Certain EFI design constraints may necessitate individually constructed EFIs with hand-placed or machine-placed components, such as flyers, barrels, and electrodes that electrically couple the firesets to the bridges. Such manually placed discrete components are prone to misalignment relative to the foil and may dislodge or move over time, which reduces EFI efficiency, reliability, and longevity.

For example, a misplaced flyer and barrel may result in a misguided flyer that reduces the effectiveness of the flyer in detonating the explosive charge.

Existing EFI construction techniques may necessitate relatively large EFIs to facilitate manual flyer and barrel placement and to mitigate inaccuracies in flyer and barrel placement. Complicated and expensive machines and processes may be required to accurately position discrete EFI components. In addition, discretely placed components are often prone to undesirable movement or displacement in response to shock or vibration, which may occur, for example, during missile flight. Furthermore, the EFIs may require excessively large and expensive firesets to produce sufficient voltage and flyer velocity to compensate for inaccuracies in EFI-component placement and design inefficiencies.

Attempts to improve EFI performance include use of a ring-shaped bridge for blasting a flyer out of a layer of flyer material, as discussed in U.S. Pat. No. 6,234,081, entitled SHAPED BRIDGE SLAPPER. Unfortunately, such EFIs generally still require manual or machine placement of discrete components, resulting in expensive and error-prone EFIs.

Hence, a need exists in the art for a compact high performance EFI and an accompanying reliable, cost-effective, and efficient process for making the EFI.

SUMMARY OF THE INVENTION

The need in the art is addressed by an actuator assembly that includes, in one example embodiment, a substrate with a bridge coupled between a first electrode and a second electrode on the substrate. A lithographically disposed flyer is positioned in proximity to the bridge.

As defined above, an actuator may be anything that causes or performs an action when activated. For example, any hardware and/or software device and/or module that performs an action, such as generating an electrical signal or initiating explosives, in response to certain input, such as a particular mechanical, electrical, or optical signal, is considered an actuator. An actuator assembly may be any collection of components of an actuator or initiator.

In a more specific embodiment, the actuator assembly further includes a lithographically disposed barrel in proximity to the flyer. A fireset is directly coupled to pins that extend through the substrate to the first electrode and the second electrode.

In the specific embodiment, the flyer further includes a three-dimensional surface adapted to flatten during flight. The flyer may be concave, convex, or may be star shaped; may have perforations therein, or may exhibit another shape or other features. The bridge may include plural legs.

The lithographically disposed barrel partially surrounds the flyer. The lithographically disposed flyer and barrel are made from a one or more polymers, such as epoxy or SU-8. One or more strategically formed grooves in the substrate facilitate securing the lithographically formed barrel to the substrate.

Another embodiment includes a three-dimensional surface that is formed on the substrate underlying the lithographically disposed flyer. The substrate includes one or more insulating materials under the first electrode, second electrode, and the bridge. The substrate includes a Printed Circuit Board (PCB) material with a hardening layer or a smoothing layer disposed on the PCB material under the bridge and lithographically disposed flyer.

Another embodiment includes an array of the actuator assemblies. The array includes plural actuator assemblies on a single substrate. Each actuator assembly may be characterized by response times less than 200 nanoseconds.

The novel design of certain embodiments discussed herein is facilitated by use of lithographical processes to form the flyer and the barrel. Use of such processes facilitates mass production of extremely precise and small EFIs with custom-shaped features, such as flyers and barrels. These factors may increase EFI reliability and further reduce energy requirements needed to set off an accompanying energetic material. Reduced energy requirements may result in smaller firesets, which may further alleviate design constraints on accompanying systems, such as missile systems, where small component size and weight are important.

DESCRIPTION OF THE INVENTION

While embodiments are described herein with reference to particular applications, it should be understood that the embodiments are not limited thereto. Those having ordinary skill in the art and access to the teachings provided herein will recognize additional modifications, applications, and embodiments within the scope thereof and additional fields in which the present invention would be of significant utility.

For clarity, various well-known components, such as optional assembly screws, housings, and so on, have been omitted from the figures. However, those skilled in the art with access to the present teachings will know which components to implement and how to implement them to meet the needs of a given application. Furthermore, the figures are not necessarily drawn to scale.

Figure 1:
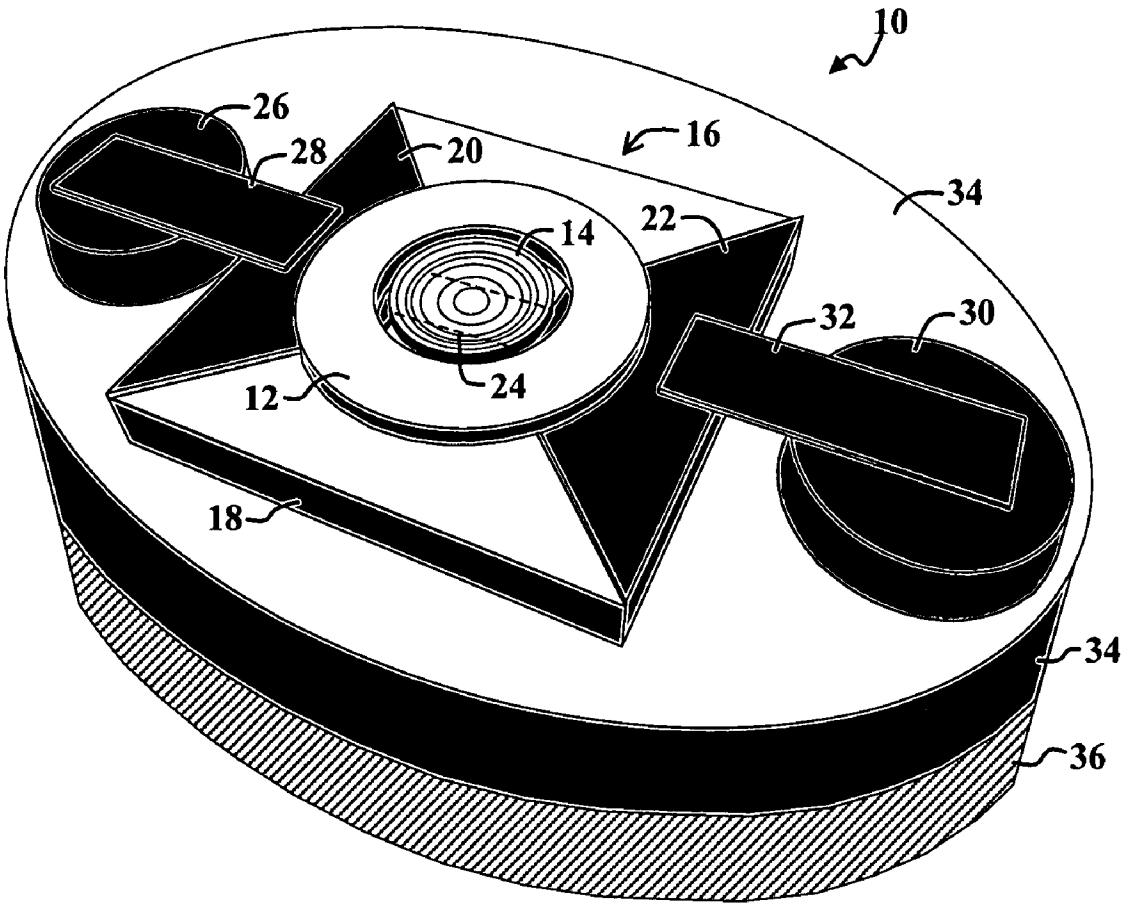
FIG. 1 is a diagram of an Exploding foil initiator (EFI) according to a first embodiment, which employs a lithographically formed barrel and concave flyer.

FIG. 1 is a diagram of an Exploding Foil Initiator (EFI) 10 according to a first embodiment, which employs a lithographically formed barrel 12 and concave flyer 14 disposed on a flyer assembly 16. For the purposes of the present discussion, an EFI may be any initiator that uses a bridge or exploding foil, also called an expanding foil, to generate kinetic energy or to otherwise launch a projectile, such as a flyer, to initiate an action. While various flyer shapes are discussed herein, including concave, convex, and star-shaped flyers, such examples are not intended to be limiting. For example, the concave flyer 14 may be replaced with a substantially flat or square flyer without departing from the scope of the present teachings.

The flyer assembly 16 includes a first substrate 18 upon which is disposed a first electrode 20 and a second electrode 22, which are also called lands. The first electrode 20 and second electrode 22 are electrically coupled via a bridge 24, the boundaries of which are shown via dashed lines. The concave flyer 14 is disposed on the bridge 24 between the electrodes 20, 22. The first electrode 20 is coupled to a first pin 26 via a first conductive plate 28. Similarly, the second electrode 22 is coupled to a second pin 30 via a second conductive plate 32. The conductive plates 28, 32 may be replaced with conductive tape or wires without departing from the scope of the present teachings.

For the purposes of the present discussion, a flyer may be any device adapted to act as a projectile or to otherwise deliver or transfer kinetic energy. Flyer material may be any material used to create a flyer. A barrel may be any guide or spacer separating a flyer from an energetic material or for directing flight of a flyer. Barrel material may be any material used to create a barrel.

The electrodes 20, 22, bridge 24, plates 28, 32, and pins 26, 30 are made from electrically conductive materials, such as copper. The exact choice of conductive materials or layers is application specific. Those skilled in the art with access to the present teachings may readily choose the appropriate conductive material to meet the needs of a given application without undue experimentation.

In the present specific embodiment, the barrel 12 is ring shaped. Edges of the ring-shaped barrel 12 overlap the first electrode 20 and the second electrode 22. The concave flyer 14 is positioned near the middle of the barrel 12 and is partially surrounded thereby. The concave flyer 14 is positioned on the bridge 24 on the first substrate 18 of the flyer assembly 16 and approximately within a cylinder formed by the barrel 12.

In the present specific embodiment, the first substrate 18 is substantially square, and the barrel 12, concave flyer 14, and bridge 24 are approximately centered on the first substrate 18 between the first electrode 20 and the second electrode 22. The flyer assembly 16 is approximately centered between the first pin 26 and the second pin 30, which extend through a second substrate 34 upon which the first substrate 18 is disposed. The second substrate 34, which is also called a header, has an oval shaped surface area.

While in the present embodiment, the substrate 34 is substantially oval, the substrate 34 may exhibit another shape, such as circular or square. In general, the exact shapes and dimensions of various components of the EFI 10 are application specific. Any of the components of the EFI 10 may be shaped differently than shown in the figures without departing from the scope of the present teachings. For example, the substrates 18, 34 may be cylindrical, square, triangular, or may have another shape that is suitable for a given application. As another example, the disk-shaped barrel 12 may be replaced with a barrel that has a square, triangular, rectangular outline. In addition, while the barrel 12 is shown having an opening where the flyer 14 resides, the barrel 12 may be substantially solid, lacking an opening. In such applications, the flyer 14 could be blown out of the barrel 12 from the force of the expanding bridge 24. Furthermore, while in the present embodiment, a space is shown between the inner walls of the barrel 12 and the flyer 14 therein, in certain embodiments, the flyer 14 may extend to the inner walls of the barrel 12 so that edges of the flyer 14 contact the barrel 12.

Those skilled in the art with access to the present teachings may readily determine the desired shape of various EFI components to meet the needs of a given application without undue experimentation and without departing from the scope of the present teachings. Furthermore, the EFI assembly 16 is shown implemented on the first substrate 18, which is on the second substrate 34. However, the flyer assembly 16 may be implemented directly on the second substrate 34 in certain embodiments.

A fireset 36 is positioned beneath the second substrate 34 and is electrically coupled to the conductive pins 26, 30. The conductive pins 26, 30 extend through the second substrate 34 to the fireset 36. The fireset 36 may be a conventional fireset and may be purchased from Tanner Research, Inc. Alternatively, the fireset 36 may be customized for fast response times, which may be important for multi-point initiation using arrays of EFIs, as discussed more fully below. Those skilled in the art with access to the present teachings may readily customize a fireset to meet the needs of a particular application without undue experimentation. For the purposes of the present discussion, a fireset may be any device for selectively producing a voltage or voltage differential. In the present specific embodiment, the fireset 36 produces a high voltage pulse between 800 to 2000 volts with a pulse rise time between approximately 5 to 100 nanoseconds. The exact voltage and voltage-pulse rise times are application specific and may be different than the values indicated.

Generally, the fireset 36 will include electronics, which may include one or more capacitors, for generating an electrical charge sufficient to explode the bridge 24 when certain predetermined conditions are met. Exact conditions for activating the fireset 36 and triggering actuation of the flyer 14 are application specific. Those skilled in the art may readily determine appropriate conditions and implement appropriate functionality in the fireset 36 or via one or more circuits coupled to the fireset 36 without undue experimentation.

In operation, when a predetermined set of conditions are met, as determined by the fireset 36 and/or electronics coupled thereto, the fireset 36 applies a voltage differential to the pins 26, 30 sufficient to explode the bridge 24. The exact voltage differential applied to the pins 26, 30 is application specific. Example voltage values suitable for various applications include 800-2000 volts.

The voltage differential applied to the pins 26, 30 causes an electrical current to flow between the pins 26, 30 via the lands 20, 22 and the bridge 24. The current is sufficiently large to melt and explode the bridge 24, converting the bridge 24 into a metallic plasma. A plasma may be any material, substance, or gas wherein atoms thereof are stripped of electrons or vice versa. The exploding or expanding plasma propels the concave flyer 14 upward and away from the EFI assembly 16 toward an energetic material positioned above and in proximity to the EFI assembly 16. Bridges that do not form a plasma when exploded or activated may be employed without departing from the scope of the present teachings.

The shape of the concave flyer 14 may be tailored to the shape of the bridge 24 or vice versa so that when the flyer 14 is propelled upward toward the energetic material, the flyer 14 flattens in flight. The flattening occurs as the bridge material, such as plasma, pushes upward on the flyer 14 near the center of the flyer 14. This causes an outer portion of the concave flyer 14 to deflect backward, flattening the front surface of the flyer 14. Flattening of the flyer 14 in flight before impact with an energetic material may enhance a resulting shock wave in the energetic material caused by impact of the flyer 14 therewith, thereby improving activation of the energetic material. Improved activation of the energetic material may correspond to improved detonation efficiency in applications wherein the energetic material is an explosive that detonates when activated.

For the purposes of the present discussion, an energetic material may be any substance that is adapted to release energy in response to application of a predetermined signal, such as a signal created by an impact from a flyer. Examples of energetic materials include explosives, such as those used in missile systems and other munitions; hypergolic materials, such as those used to start solid rocket motors; and so on. The terms explosives, explosive materials, and explosive charges are used interchangeably herein.

For the purposes of the present discussion, a signal may be any conveyed information or action or that which is employed to convey the information. For example, a radio signal may be the information conveyed in a transmitted radio wave, or the signal may be the radio wave itself. Signals are often named after the medium employed to convey information in the signal. Additional examples of signals include chemical, mechanical, optical, electrical, and electrochemical signals. For example, a mechanical action that activates an explosion, the explosion itself, a mechanical signal that causes mixing of solid rocket motor hypergolic materials, and so on, are all considered signals for the purposes of the present discussion.

In an example implementation, the energetic material includes an explosive charge in a missile. The explosive charge explodes when impacted by the concave flyer 14. In this example, a controller in the fireset 36 is coupled to one or more sensors in the missile. The sensors may include one more accelerometers and/or Inertial Measurement Units (IMUs) to determine when the missile is launched and when the missile has impacted a target. Missile launch and target impact may produce a predetermined pattern of acceleration, deceleration, and so on. Acceleration information from one or more sensors may be input to a controller in the fireset 36. The controller may compare the measured or sensed acceleration information with a predetermined pattern that is consistent with missile launch and target impact. When the acceleration profile matches that of a missile launch and target impact, the fireset 36 may then apply a sufficient voltage to the pins 26, 30 to explode the bridge 24, thereby propelling the flyer 14 toward the explosive charge, thereby exploding the missile.

The bridge 24 may be constructed from a thin metallic foil, such as gold or copper foil. The shape, size, and thickness profile of the bridge 24 may be adjusted to create a desired shock wave to propel the concave flyer 14 through the barrel 12 and to ensure that the concave flyer 14 exhibits desired flight characteristics when moving from the EFI assembly 16 toward an energetic material, as discussed more fully below. For example, in certain applications, the desired flight characteristics include the concave flyer 14 flattening in flight. In other applications, the flyer 14 may spin or rotate at a desired rate about a desired axis of the flyer 14 to facilitate penetration of the flyer 14 into an energetic material.

For the purposes of the present discussion, a foil may be any device adapted to release kinetic energy, such as in the form of flying plasma or other material, in response to a predetermined signal, such as a voltage or current. The terms bridge and foil are employed interchangeably herein. Various electrically conductive materials may be suitable for constructing the bridge 24. For example, the bridge 24 may be constructed chromium or titanium and gold. Other metals, such as titanium, Ni/Chrome alloys, tungsten, and so on, can also be used. In the present embodiment, the bridge 24 (exploding foil) is created with lithographical thin film deposition and patterning techniques, ensuring that the bridge 24 makes proper contact with the lands 20, 22.

In the present specific embodiment, various components 12, 14, 20, 22, 24 of the EFI 10 are lithographically formed via one or more low temperature lithographic processes. For the purposes of the present discussion, an EFI component, such as a barrel or flyer, is said to be lithographically disposed or formed on an EFI if it is formed on the EFI via one or more steps involving use of photosensitive materials that are masked and selectively denatured or polymerized by electromagnetic energy, such as ultraviolet light, to facilitate forming the component. A photosensitive material may be any material having properties that may be affected by a predetermined wavelength of electromagnetic energy. Hence, materials that change properties when exposed to X-rays, ultraviolet light, blue light, or other types of electromagnetic energy are all considered to be photosensitive materials.

Examples of photosensitive materials include positive or negative photoresist, which may be masked, exposed to ultraviolet light, and then washed or etched, yielding a desired pattern in the photoresist. For example, photoresist may be applied to a substrate. A mask may then be used to expose certain portions of the photoresist to ultraviolet light, thereby changing properties of the photoresist in desired regions, such as regions exposed by the mask to the light. The resulting photoresist may be washed or etched, leaving a pattern of photoresist. The remaining patterned photoresist may cover certain portions of a substrate, which may include ceramic, PCB material, Parylene disposed on silicon, and/or other material. Subsequently, an etchant may be applied to the substrate to etch or wash unexposed regions on the substrate, thereby yielding desired patterns in the substrate. For the purposes of the present discussion, an etchant or wash may be any material or mechanism for removing a first material from a second material or location.

In the present specific embodiment, the substrates 18, 34 are made from silicon, alumina, or ceramic. However, other materials may be used without departing from the scope of the present teachings, as discussed more fully below.

Figure 2:
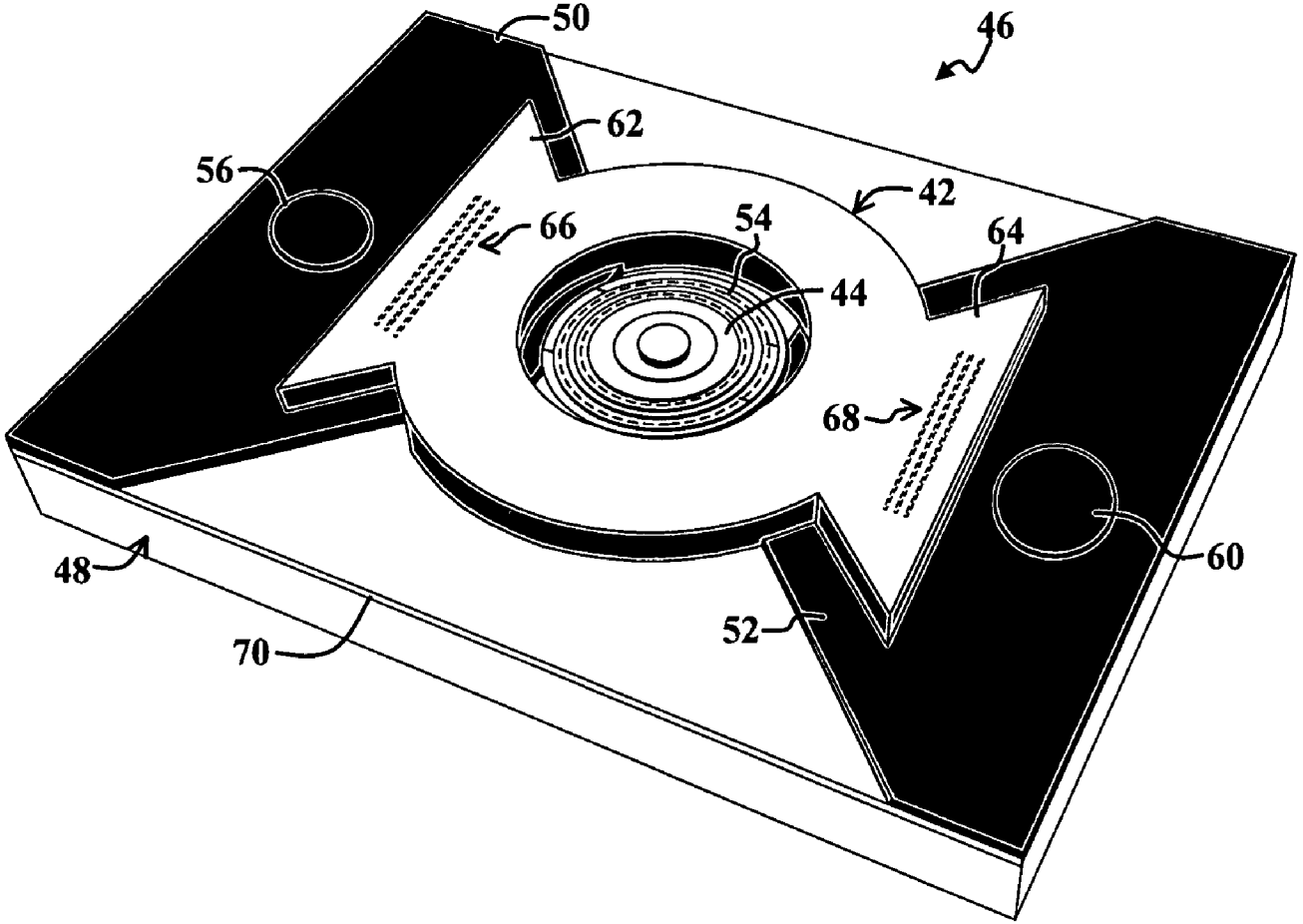
FIG. 2 is a diagram of an EFI assembly according to a second embodiment, which includes a lithographically formed convex flier and includes contact pins that directly contact lands of the EFI assembly.

FIG. 2 is a diagram of an EFI assembly 46 according to a second embodiment, which includes a lithographically formed convex flier 44 and includes contact pins 56, 60 that directly contact lands 50, 52 of the EFI assembly 46.

The construction and operation of the EFI assembly 46 are similar to the construction and operation of the EFI assembly 16 of FIG. 1 with various exceptions. In particular, the substrate 18 of the EFI assembly 16 of FIG. 1 is replaced with a PCB substrate 48 in the EFI assembly 46 of FIG. 2. In addition, the barrel 12 of FIG. 1 is replaced with a tabbed barrel 42 in FIG. 2, which has a first tab 62 and a second tab 64 extending therefrom. Furthermore, the first pin 26 and second pin 30 of FIG. 1 are replaced with a third pin 56 a fourth pin 60 in FIG. 2, respectively. The pins 56, 60 directly contact a third land 50 and a fourth land 52, respectively, and extend through the substrate 48 to a fireset, which is not shown in FIG. 2. In addition, the concave flyer 14 of FIG. 1 is replaced with the convex flyer 44 of FIG. 2. Furthermore, the bridge 24 of FIG. 1 is replaced with a ring-shaped bridge 54 in FIG. 2. In addition, the lands 50, 52 of FIG. 2 include a first set of grooves 66 and a second set of grooves 68 extending there through. The grooves 66, 68, which are also called locking rings, extend into the PCB substrate 48. While in the present specific embodiment, the tabs 62, 64 are shown extending over the lands 50, 52, the tabs 62, 64 may extend over the substrate 48 instead without departing from the scope of the present teachings. Furthermore, the grooves 6, 68 may extend into the substrate 48 without extending through the lands 50, 52.

The tabs 62, 64 may facilitate distributing the pressure of packaging materials and/or energetic material or housing thereof on the EFI 46, which may enhance the reliability of the EFI 46. In addition, the tabs 62, 64 and grooves 66, 68 may help to ensure that the barrel 42 does not shift or otherwise detach from the EFI 46 in high-shock or vibration-prone environments or during activation of the bridge 54, as discussed more fully below.

In operation, the ring-shaped bridge 54 is shaped so that when sufficient voltage is applied via the pins 56, 60 by a fireset, resulting exploding or expanding plasma from the bridge 54 propels the convex flyer 44 by pushing on outer portions of the convex flyer 44 that overlay portions of the ring-shaped bridge 54. This causes the convex flyer 44 to substantially flatten in flight. The stiffness of the convex flyer 44 in different portions of the flyer 44 is tailored for desired flight characteristics of the convex flyer 44. For example, the stiffness profile across a lateral dimension of (e.g. across the diameter of) the convex flyer 44 may be adjusted so that the convex flyer 44 includes stiffer material near an outer portion of the flyer 44 to prevent over bending of the convex flyer 44 when the ring-shaped bridge 54 is detonated. The stiffness profile of the convex flyer 44 across a vertical dimension of the flyer 44 may also be adjusted as needed to facilitate achieving a desired flight characteristic or shock-wave formation upon impact with an energetic material.

In general, the stiffness profile, shape, thickness profile, and material composition of the flyer 44, bridge 54, and barrel 42 may be adjusted to achieve flyer flight characteristics that are suitable for a given application. The ability to tailor such dimensions and characteristics of various EFI assembly components is facilitated by use of a special lithographical process used to form the components.

Use of a PCB as the substrate 48 facilitates routing the pins 56, 60 through the substrate 48. Silicon substrates for EFI assemblies may require more expensive processes to construct through-vias through which contact pins are extended. For example, in certain silicon implementations, through-vias in a substrate may require coating with an insulating layer before pins are inserted therethrough. This can be expensive. PCB substrates are generally not conductive or semiconductive, and vias therethrough generally need not be coated with an additional electrical insulator material.

The pins 56, 60 may be placed in the substrate 48 before deposition of the lands 50, 52 so that when the lands 50, 52 are deposited on the substrate 48, they bond with or otherwise electrically couple to the pins 56, 60. Alternatively, the lands 56, 60 are formed before vias for the pins 56, 60 are drilled or etched (e.g. via deep reactive ion etching) through the substrate 48 and lands 56, 60. Subsequently, solder or other material may be deposited on the pins 56, 60 and lands 50, 60 to electrically couple the pins 56, 60 to the lands 50, 52. Generally, use of solder or direct bonding of the pins 56, 60 to the lands 50, 52 via metal deposition processes eliminates the need for less reliable wire bonding or use of plates, such as the plates 28, 32 of FIG. 1. Furthermore, assembly costs may be reduced, as components, such as wires, need not be discreetly placed on the EFI assembly 46. Components of the EFI assembly 46 may be manufactured via batch lithographical processing, as discussed more fully below.

A PCB material, such as that used to construct the PCB substrate 48, may be any polymer or polymer composite suitable for disposing a circuit thereon. A PCB may be any board, substrate, or material layer that is adapted to accommodate a circuit. Conventionally, PCBs are often made of one or more layers of insulating material, such as Flame Resistant 4 (FR4), upon which a circuit is disposed or to be disposed, such as via etching techniques.

In the present specific embodiment, the PCB substrate 48 includes a hardening layer 70, which also acts as a smoothing layer to improve performance of the bridge 54. For the purposes of the present discussion, a smoothing layer may be any layer of material, such as a polymer material, that is adapted to reduce surface roughness or to otherwise provide a desired consistent texture on the surface of a circuit board or other substrate. The hardening layer 70 is chosen to reduce any energy losses resulting from the plasma produced by the exploding or expanding bridge 54 penetrating the substrate 48 when the bridge 54 is activated. The hardening layer 70 may increase launch velocity of the convex flyer 44 for a given voltage applied to the pins 56, 60.

When a sufficient voltage differential is applied to the pins 56, 60, the ring-shaped bridge 54 will explode or expand, propelling the convex flyer 44 upward. A front surface of the convex flyer 44 will flatten as the flyer 44 is pushed upward by plasma bursting from the ring-shaped flyer 44 near an outer portion of the flyer 44.

The grooves 66, 68 in the lands 50, 52 and PCB substrate 48 facilitate bonding of the barrel 42 to the substrate 48. The tabs 62, 64 further increase the bonding surface area of the barrel to the EFI assembly 46 and may facilitate distributing pressure from the weight of components, such as energetic materials and/or packaging, that are positioned atop the barrel 42. The increased bonding surface area and the grooves 66, 68 help to secure the barrel 42 to the EFI assembly 46 during activation of the flyer 44 and during handling of the EFI assembly 46 over the life of the EFI assembly 46. This may increase reliability and longevity of the EFI assembly 46.

The barrel 42 is formed on the substrate 48 via a lithographical process, as discussed more fully below. The barrel 42 and flyer 44 may be implemented via Kapton®, SU-8, or other polymer material that is easily processed via lithographical processes. For the purposes of the present discussion, a lithographical process may be any process that employs electromagnetic energy, such as light, X-rays, or other electromagnetic energy, and one or more masks.

While the present example embodiment is made via a lithographical process using negative photoresist and ultraviolet light to create the barrel 42 and flyer 44 on the substrate 40, other types of photoresist and other types of electromagnetic energy other than ultraviolet light may be employed. For the purposes of the present discussion, negative photoresist may be any material that becomes more robust when exposed to ultraviolet light. Positive photoresist becomes less robust when exposed to ultraviolet light.

An example lithographical process, which may be used to make the flyer 44 and barrel 42, uses negative photoresist, ultraviolet light, and a mask. A layer of polymer material, such as epoxy, may be spun over the surface of the substrate 48 before the epoxy cures and hardens. The epoxy may be heated to facilitate penetration of the epoxy into the grooves 66, 68. After the polymer (epoxy) cures and hardens, a layer of negative photoresist may then be applied to the polymer layer. A mask having an opening in the shape of the barrel 42 may then be positioned over the resulting negative photoresist layer. Ultraviolet light is then exposed to the negative photoresist that is exposed to the light via openings in the mask. The negative photoresist then hardens, protecting the polymer material beneath it. The surrounding photoresist, after the mask is removed, may be washed away or etched. The surround polymer material may then be etched or otherwise removed, leaving a structure in the shape of the barrel 42. Subsequently, the hardened photoresist may then be removed if desired via an etchant designed to remove the photoresist. For the purposes of the present discussion, an etchant may be any material or mechanism for removing a first material from a second material or location.

Alternatively, the polymer material comprising the barrel 42 may be a photoresist material itself, such as SU-8, which acts as a negative photoresist. In such implementations, the photoresist may be spun over the surface of the substrate 48. After the photoresist cures, a mask with an opening in the shape of the barrel 42 is positioned over the photoresist, and the resulting assembly is exposed to ultraviolet light. The ultraviolet light further hardens or polymerizes the photoresist that is exposed via the opening in the mask. The mask is then removed, and the unexposed photoresist is washed away, leaving a structure in the shape of the barrel 42.

The above example processes may be repeated to adjust the thickness of the barrel 42 or to add other features to the EFI assembly 46, such as the convex flyer 44. Alternatively, the barrel 42 and flyer 44 may be formed in parallel using the same lithographical process. In the present embodiment, the lands 50, 52 and the ring-shaped bridge 54 are also formed via a lithographical process.

Various lithographical processes are suitable for creating the barrel 42 and flyer 44. For example, the convex flyer 44 may be formed by repeating the above example process using successive masks with successively smaller apertures therein. Those skilled in the art with access to the present teachings may readily implement requisite features of the EFI assembly 46 using one or more lithographical processes without undue experimentation.

Lithographical processes used to create the barrel 42 and flyer 44 may be low temperature processes suitable for use with integrated circuits. Integrated circuits may be positioned beneath the substrate 48 or on the opposite side of the substrate from the barrel 42, flyer 44, and bridge 54. Processes requiring excessive heat that could damage any accompanying electronics need not be employed.

Hence, relatively low temperature lithographic processes may be used to create virtually all features of the EFI assembly 46. Furthermore, such processes may be used to make hundreds or thousands of the EFIs on a single substrate via batch lithographical processing. This significantly reduces the costs of the EFI assembly 46 and obviates the need to employ expensive pick and place methods to place discrete components on an EFI. Furthermore, lithographic processes may facilitate constructing EFI components with extremely accurate dimensions and tolerances, which may improve the reliability, accuracy, and efficiency with which the EFI detonates accompanying explosives.

Furthermore, use of lithographic processes discussed herein and discussed more fully below may facilitate constructing various barrel and flyer shapes that heretofore have been prohibitively expensive to manufacture and position on an EFI. By reducing the requisite size of EFI assemblies, such as the EFI assembly 46, via use of lithographic processes, and by enabling more accurately dimensioned components, reliability of the EFI 46 may be significantly enhanced. EFIs with enhanced reliability may improve performance of accompanying energetic systems, such as missile systems, solid rocket motors, and so on.

In addition, use of strategically shaped flyers, such as the convex flyer 44 of FIG. 2 and the concave flyer 14 of FIG. 1 may further reduce the kinetic energy that must be produced by the flyer to set off an accompanying explosive or energetic material. By reducing the energy needs required to activate an accompanying energetic material, smaller voltage differentials may be applied to the pins 56, 60. This reduces the size of the requisite fireset used to apply the sufficient voltage to the pins 56, 60. Smaller firesets may reduce design constraints on accompanying systems, such as missiles systems, where size and weight of accompanying components are important design considerations.

Test results show that response times for EFI assemblies constructed in accordance with the present teachings may be less than 100 nanoseconds, which is significantly faster than many preexisting EFI assemblies.

Figure 3:
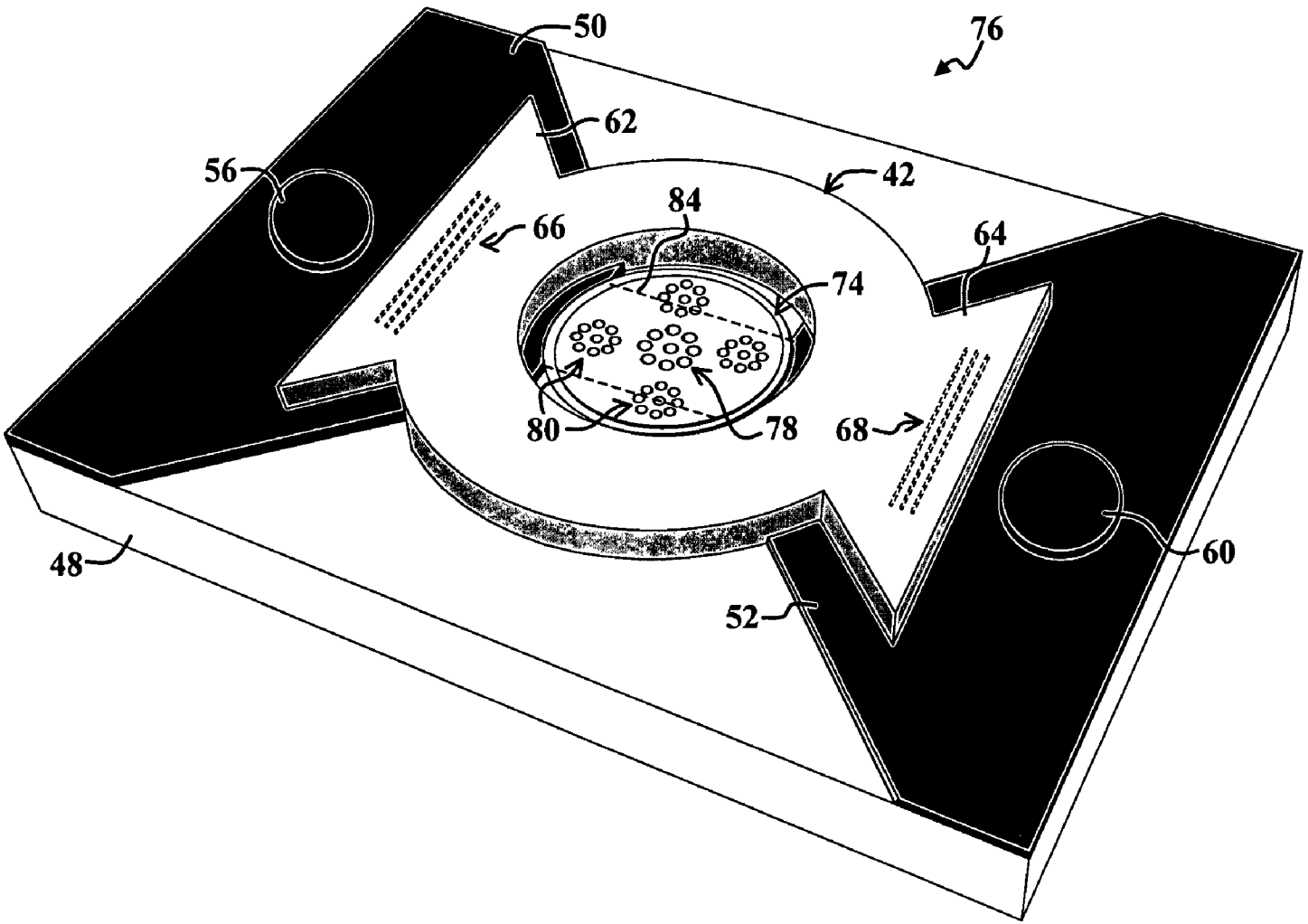
FIG. 3 is a diagram of an EFI assembly according to a third embodiment, which includes a lithographically formed strategically perforated flyer with contact pins that directly contact the lands of the EFI assembly.

FIG. 3 is a diagram of an EFI assembly 76 according to a third embodiment, which includes a lithographically formed strategically perforated flyer 74 with contact pins 56, 60 that directly contact the lands 50, 52 of the EFI assembly 76.

The construction and operation of the EFI assembly 76 are similar to the construction and operation of the EFI assembly 46 of FIG. 2 with various exceptions. In particular, the convex flyer 44 of FIG. 2 is replaced with the strategically perforated flyer 74 in FIG. 3. Furthermore, the ring-shaped bridge 54 of FIG. 2 is replaced with a rectangular bridge 84 in FIG. 3

The strategically perforated flyer 74 includes a first set of perforations 78, which are approximately centered on the perforated flyer 74. Several sets of smaller perforations 80 are positioned near the outer edges of the perforated flyer 74. The exact placement of the perforations 78, 80 may be altered, and different shapes, sizes, and arrangements of perforations may be altered without departing from the scope of the present teachings.

In the present specific embodiment, the perforations 78, 80 are sized and positioned so that when the bridge 84 explodes, the resulting exploding or expanding plasma pushes on the flyer 74 with a desired force distribution. With larger perforations 78 near the center of the flyer 74, and smaller perforations 80 near the periphery of the flyer 74, the exploding or expanding plasma will exert forces on the underside of the flyer 74 resulting in the flyer 74 flying substantially flat. Without the perforations 78, 80, the exploding or expanding bridge 84 may exert more pressure near the center of the flyer 74, which could cause the flyer 74 to exhibit a mushroom shape rather than a substantially flat shape during flight. Note that the sizes and positioning of the perforations 78, 80 may be tailored or adjusted based on the shape, size, thickness profile, and so on, of the underlying bridge 84.

Alternatively, dimensions and placement of the perforations 78, 80 are selectively tailored so that the exploding foil 84 will cause the flyer 74 to spin or rotate in flight. The spinning or rotating of the flyer 74 may be tuned by adjusting characteristics of the perforations 78, 80 and the bridge 84. Exact flyer flight characteristics, such as spin rate, are application specific. Different flyer flight characteristics may be more desirable for some applications and less desirable for others. Those skilled in the art with access to the present teachings may readily determine the desired flyer flight characteristics and requisite bridge and perforation dimensions required for a particular application, without undue experimentation.

The various flyers 14, 44, 74 of FIGS. 1-3 are shown for illustrative purposes. Other types and shapes of flyers may be employed now that a suitable manufacturing process as discussed herein has been devised to facilitate cost-effectively creating custom-shaped flyers. For example, pointed flyers or other flyer shapes, such as rectangular or initially flat flyers, may be employed to reduce energy requirements and sizes of accompanying firesets.

Figure 4:
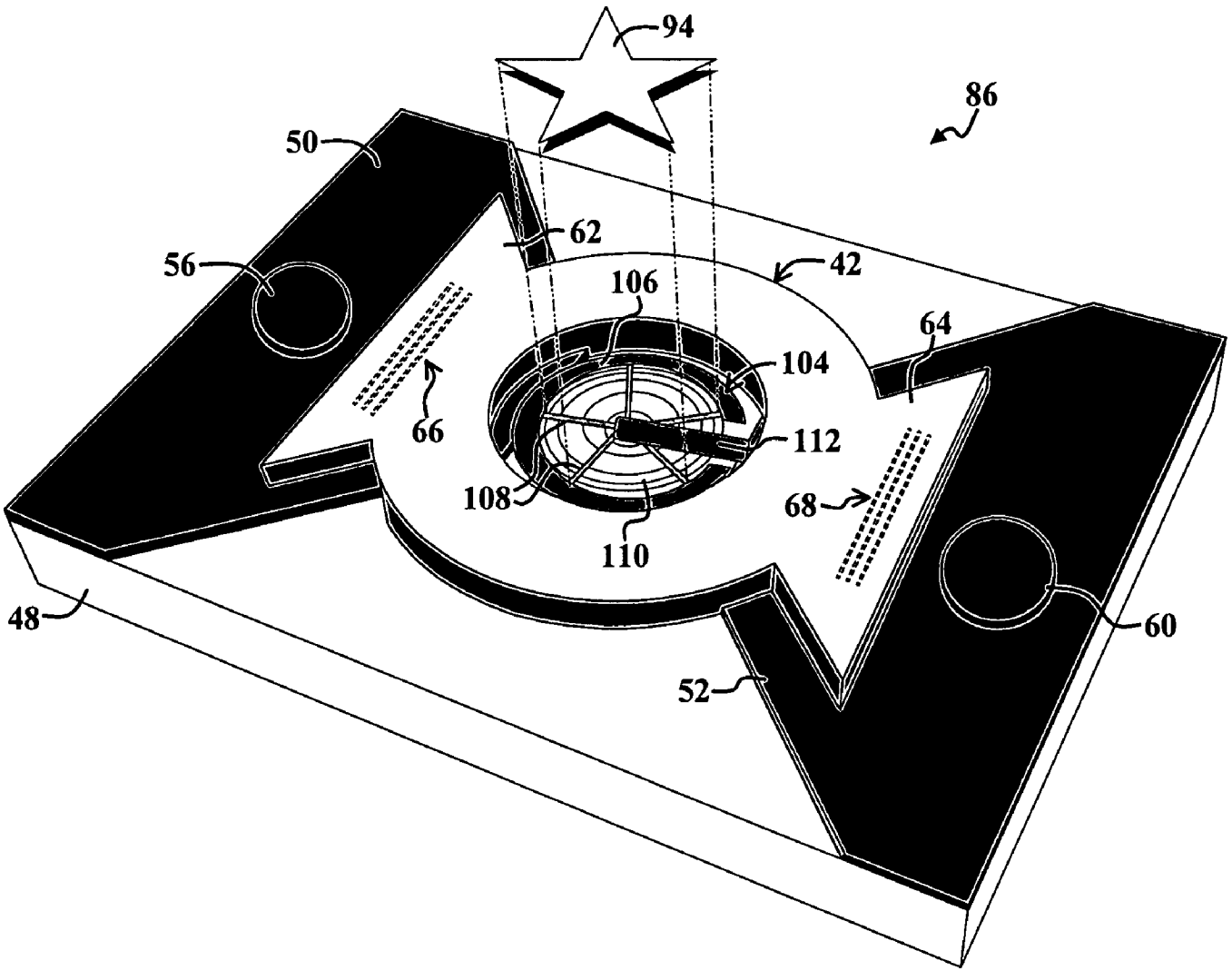
FIG. 4 is a diagram of an EFI assembly according to a fourth embodiment, which includes a special bridge on strategically shaped three-dimensional base formed on a PCB substrate.

FIG. 4 is a diagram of an EFI assembly 86 according to a fourth embodiment, which includes a special bridge 104 on strategically shaped three-dimensional base 110, which is formed on the PCB substrate 48.

The construction of the EFI assembly 86 is similar to the construction and operation of the EFI assembly 46 of FIG. 3 with various exceptions. In particular, the rectangular bridge 84 of FIG. 3 is replaced with the so-called star bridge 104 in FIG. 4. In addition, the perforated flyer 74 of FIG. 3 is replaced with the star-shaped flyer 94 in FIG. 4. Furthermore, the surface upon which the star-shaped flyer 94 is disposed is the three-dimensional (3d) surface 100. For the purposes of the present discussion, a three-dimensional surface may be any curved or shaped surface. A star-shaped flyer may be any flyer that has one or more extensions or protrusions therefrom extending from a body of the flyer in any direction.

The 3D surface 110 is strategically shaped to affect flight characteristics of the star-shaped flyer 94. In particular, the example 3D surface 110 is convex. The convex shape may be formed by a lithographical process and may be formed via epoxy or other suitable material. The exact choice of material is application specific and may be readily determined by those skilled in the art with access to the present teachings to meet the needs of a given application without undue experimentation. When the star-shaped flyer 94 is disposed on the 3D surface 110, the flyer 94 is also partially convex. The star-shaped flyer 94 is designed to substantially flatten during flight when launched via the star bridge 104.

The convex surface 110 underlying the so-called star bridge 104 and star flyer 94 is shaped to cause the star-shaped flyer 94 to fly substantially flat. Alternatively, the bridge 104 may be designed with legs 108 of varying thickness so that the legs 108 explode in sequence, thereby imparting a spin or rotation to the star-shaped flyer 94. The resulting rotating or spinning flyer 94 may penetrate further into an accompanying energetic material. This may improve efficiency or ease with which the flyer 94 activates the accompanying energetic material. This may in turn reduce the requisite size of an accompanying fireset used to apply voltage to the pins 56, 60 and bridge 104.

The star bridge 104 includes the legs 108, which extend between a center bridge portion 112 and an outer bridge portion 106. Sufficient voltage applied between the outer bridge portion 106 and the center bridge portion 112 causes the bridge 104 and accompanying legs 108 to explode, propelling the star flyer 94 upward through the barrel 42 toward an energetic material.

A bridge, such as the bridge 104 is said to have plural legs if the bridge is designed to explode plural bands of bridge material. Hence, a bridge with legs need not have material bands that are visible before the bridge explodes.

Figure 5:
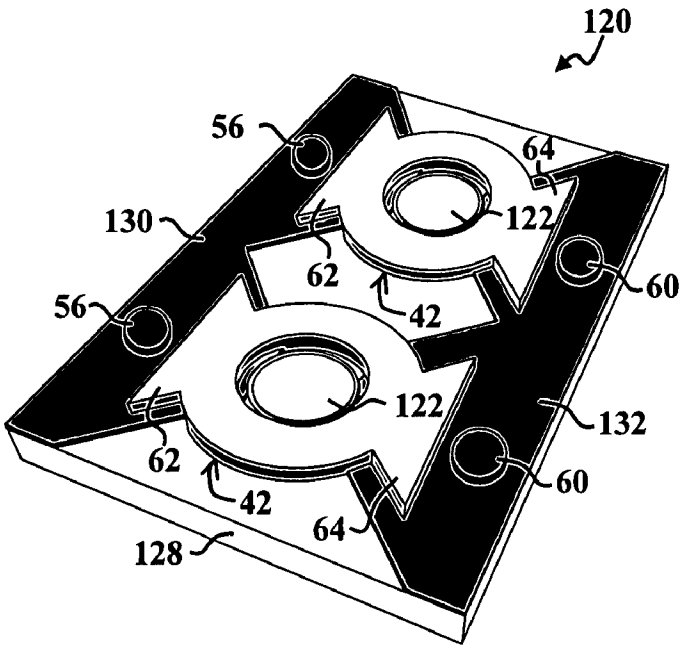
FIG. 5 is a diagram of an EFI assembly array according to a fifth embodiment.

FIG. 5 is a diagram of an EFI assembly array 120 according to a fifth embodiment. The example array 120 includes plural barrels 42 and accompanying flyers 122 therein. The flyers 122 overlay bridges, which are not shown in FIG. 5. While the flyers 122 are shown as substantially flat disc-shaped flyers without perforations or three-dimensional convex or concave surfaces, the flyers 122 may be replaced with other flyers, such as shaped and/or perforated flyers, without departing from the scope of the present teachings. For example, the flyers 122 and accompanying bridges may be constructed in accordance with any of the embodiments of FIGS. 1-4.

The EFI assembly array 120, which is also called a detonation or initiation array, further includes a first electrode 130 with a first set of pins 56 therethrough and a second electrode 132 with a second set of pins 60 therethrough. The electrodes 130, 132, barrels 42, flyers 122, and accompanying bridges are formed on an array substrate 128, which accommodates the plural flyer assemblies of the EFI assembly array 120.

While only two barrels 42 and flyers 122 are shown in FIG. 5, arrays with more EFI assemblies may be incorporated in an EFI array without departing from the scope of the present teachings. EFI arrays, such as the array 120 may be tailored to yield a set of flyers that launch from the array 120 in a desired pattern, producing a so-called shaped detonation wavefront, which is useful for multi-point detonation applications. The exact shape and properties of the resulting shaped detonation wavefront is application specific and may be adjusted by those skilled in the art with access to the present teachings to meet the needs of a given application. Substantially planar wavefronts or three-dimensional wavefronts may be created by adjusting the timing of the firing of various flyers in an array.

While the EFI array 120 is shown including common electrodes 130, 132 for each flyer 122, different electrodes may be employed for each flyer 122. Furthermore, while multiple pins 56, 60 are shown for each electrode 130, 132, a single pin may be employed for each electrode without departing from the scope of the present teachings. Furthermore, an electrode may lack pins. For example, the pins 56 may be removed, and the first electrode 130 may be grounded. An accompanying fireset may then apply sufficient voltage to the pins 60 to create a sufficient current in the bridges underlying the flyers 122 to explode the bridges, propelling the flyers 122 toward an energetic material.

Use of multiple flyers to detonate or activate an accompanying energetic material may reduce the energy-producing requirements of an accompanying fireset, thereby reducing the requisite size and cost of the fireset.

Figure 6:
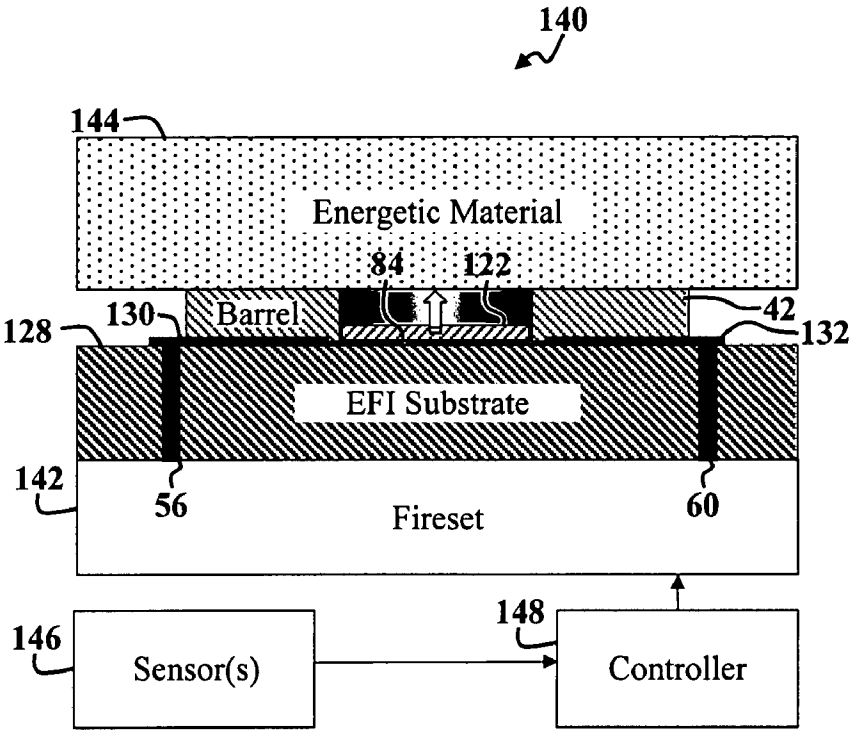
FIG. 6 is a cross-sectional diagram illustrating positioning of an EFI assembly relative to a fireset and an energetic material.

FIG. 6 is a cross-sectional diagram illustrating positioning of an EFI 140 relative to a fireset 142 and an energetic material 144, such as an explosive charge. In the present specific embodiment, the fireset 142 is positioned below the PCB EFI substrate 128, which includes pins 56, 60 extending therethrough to the electrodes 130, 132, respectively. A bridge 84 is coupled between the electrodes 130, 132 and is positioned beneath the flyer 122, which is in the barrel 42. An energetic material 144 rests on top of the barrel 42, enclosing the flyer 122 therein.

In operation, sensors 146 provide sensed information pertaining to activation criteria to a controller 148. The sensors 146 may include one or more accelerometers, IMUs, temperature sensors, launch and impact sensors, timers, and so on. The controller includes machine-readable instructions for employing sensed information as provided by the sensors 146 to determine if predetermined conditions are met. Example predetermined conditions include sensed information indicating that an accompanying missile has been launched, has traveled a predetermined trajectory, and has impacted a target. When such predetermined conditions are sensed, the controller 148 issues a signal to the fireset 142. The fireset 142 then applies a voltage across the pins 56, 60 in response to the signal. The voltage explodes the bridge 84, which is electrically coupled between the pins 56, 60, thereby turning the bridge 84 into a plasma. The plasma propels the flyer 122 upward into the energetic material 144 at high speeds, thereby activating or detonating the energetic material 144. Detonation of the energetic material 144 may represent a second signal that is produced in response to a first signal from the controller 148.

Figure 7:
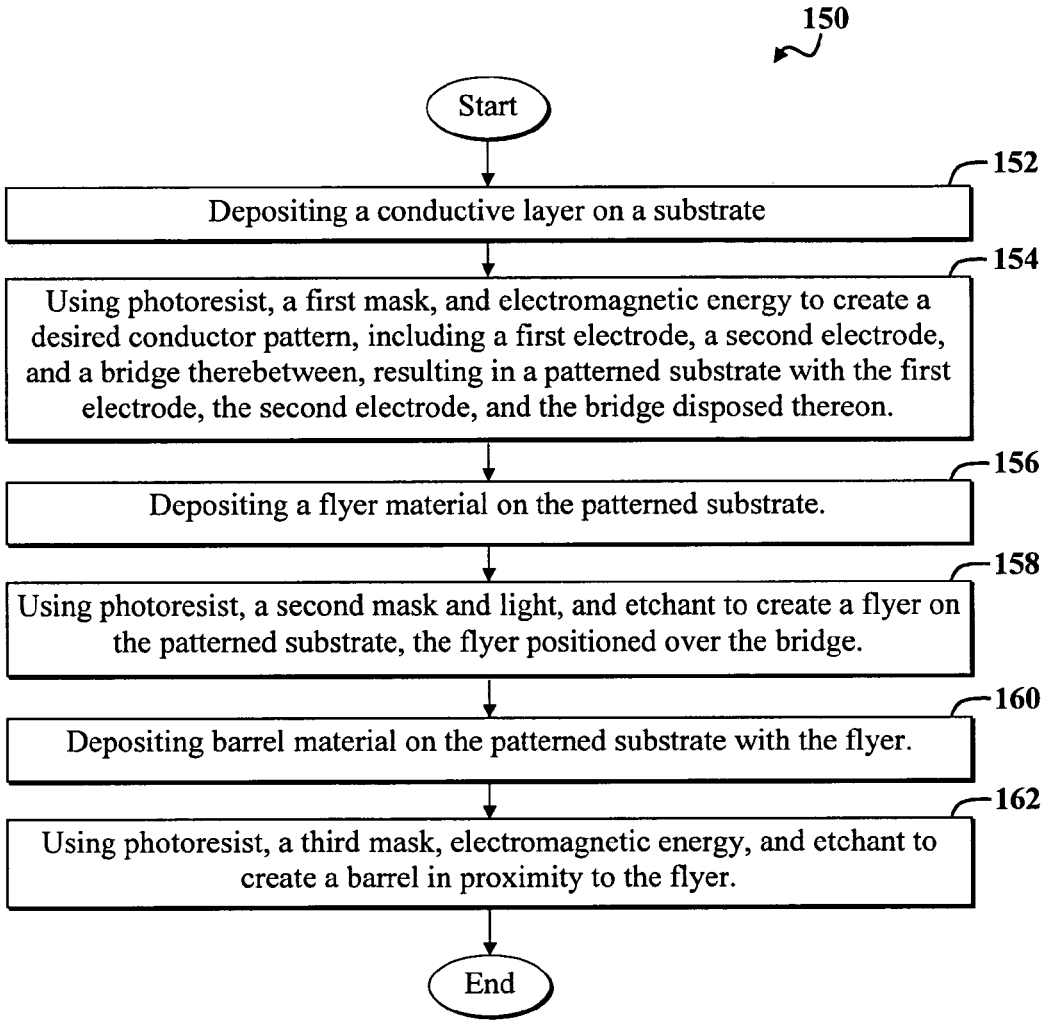
FIG. 7 is a flow diagram of an example process for making the EFI assemblies of FIGS. 1-5.

FIG. 7 is a flow diagram of an example process 150 for making the EFI assemblies 16, 46, 76, 86, 120 of FIGS. 1-5. A first step 152 includes depositing a conductive layer on a substrate.

A second step 154 involves patterning the conductive layer via photolithography. For the purposes of the present discussion, lithography may include any process that involves using a material that is sensitive or otherwise changes properties in response to electromagnetic energy, such as ultraviolet light, to create a device or feature of a device or object.

For example, photoresist, a first mask, ultraviolet light, and etchant and/or photoresist wash may be used to create a desired conductor pattern, including a first electrode, a second electrode, and a bridge therebetween. This results in a patterned substrate with the first electrode, the second electrode, and the bridge disposed thereon.

A third step 156 includes depositing a flyer material on the patterned substrate. The flyer material may be epoxy that is spun on when the epoxy is in a fluid state and not yet cured. To spin on epoxy, a predetermined amount of mixed uncured epoxy resin and hardener may be poured on the substrate. The substrate is subsequently spun about an axis perpendicular to the substrate to level the epoxy on the surface of the substrate. The epoxy is allowed to harden and cure before subsequent steps are performed. Alternatively, photoresist or another polymer may be used in place of the epoxy.

A fourth step 158 includes using photoresist, a second mask, ultraviolet light, and etchant to create a flyer on the patterned substrate. The resulting flyer is positioned over the bridge. The flyer may be formed from the photoresist material itself, which may be, for example, SU-8, which may act as a negative photoresist.

A fifth step 160 includes depositing barrel material on the patterned substrate with the flyer. The barrel material may be the same material, such as epoxy, used to create the flyer. The exact type of polymer or epoxy used to create the flyer and barrel are application specific. Those skilled in the art with access to the present teachings may readily choose the appropriate material for the flyer and barrel for a given application. Furthermore, materials other that polymers may be used to construct the flyer and barrel without departing from the scope of the present teachings.

A sixth step 162 includes using photoresist on the barrel material in addition to a third mask, ultraviolet light, and etchant to create a barrel in proximity to the flyer. Note that various types of photoresist may be employed, including positive and/or negative photoresist.

Various steps of the method 150 may be modified, replaced by or combined with other steps, interchanged with other steps, or omitted without departing from the scope of the present teachings. For example the third step 156 and the fourth step 158 may be combined with the fifth step 160 and sixth step 162 so that the flyer and the barrel or portions thereof are constructed simultaneously using the same lithographical steps. As another example, the flyer and barrel may be made from photoresist material, such as SU-8, which may simplify lithographic processes used to create the flyer and barrel.

In addition various steps may be added to the method 150. For example, a step involving spinning on a smoothing or hardening layer on the substrate may be added for embodiments involving use of a PCB substrate. The method 150 represents a relatively low temperature process suitable for use with various substrates and component materials, including PCB substrates and polymer flyers and barrels, copper electrodes, and so on.

An example more detailed method for creating a specific embodiment of an EFI assembly includes:

1. Obtain a bare substrate, which may be a silicon or ceramic wafer, PCB board, or other suitable material.
2. Optionally apply a hardening or smoothing layer to the substrate.
3. Apply 2-micron thick photoresist.
4. Pattern photoresist for Deep Reactive Etch (DRE) of grooves, i.e., locking rings (depth 10-80 microns).

5. Etch locking rings and strip photoresist.
6. Deposit silicon dioxide electrically insulating layer over the substrate surface.
7. Deposit a thin base metallic layer (metal seed layer) used to form EFI electrodes, i.e., lands, and one or more bridges.
8. Apply 3-10 micron thick photoresist.
9. Use one or more masks to pattern the photoresist and to etch the base metallic layer in preparation for deposit of 50×50-micron to 400×400-micron EFI bridges.
10. Plate 3-7 micron thick copper for a first bridge layer, depending on desired bridge dimension.
11. Deposit gold layer, thereby resulting in one or more copper and gold bridges.
12. Strip the photoresist. Stripping of the photoresist removes any gold that is on the photoresist in a process called lift off, which leaves gold in exposed regions corresponding to the locations of the bridges. This step results in a substrate with a silicon dioxide insulating layer underlying a metal seed layer with copper/gold bridges thereon.
13. Apply 5-8-micron thick photoresist as needed based on the thickness of the base metallic layer.
14. Pattern photoresist in preparation for etching the base metallic layer.
15. Etch the base metallic layer, thereby resulting in EFI electrodes coupled to the EFI bridges.
16. Apply 9-48-micron thick SU-8 polymer layer. SU-8 is a polymer material often used as a negative photoresist, which can readily be spun onto various substrates. However, here it is used to form flyers and barrels.
17. Use one or more masks and ultraviolet light to pattern SU-8 to form one or more flyers.
18. Apply 100-800-micron thick SU-8 layer over the resulting substrate and accompanying electrodes and bridges.
19. Use one or more masks and ultraviolet light to pattern SU-8 to form one or more EFI barrels around the one or more bridges.
20. Dice the substrate to separate individual EFI assemblies formed via the batch process.

Variations of the above detailed example method include employing a PCB substrate or wafer instead of a silicon or ceramic substrate; surface etching of the copper/gold bridges into convex or concave surfaces; using multiple layering of the flyer to create heavier or stiffer outer ringed surfaces or thinner outer ringed surfaces; using two-dimensional micron-scale shaping of the flyer(s) to yield a star-shaped flyer(s) or flyer(s) with other shapes or patterns; connecting or not connecting the outer diameter of the flyer(s) to the inner diameters of the barrels; using Deep Reactive Ion Etching (DRIE) to create through holes in the substrate for filled plated vias or through holes for header pins; and so on.

Use of lithographical methods for making EFI assemblies and components discussed herein are suitable for mass fabrication of small highly precise EFI assemblies. This may enhance EFI reliability and activation precision. This further reduces EFI costs and may reduce energy needs required for an EFI to set off an accompanying energetic material, which may in turn reduce the size and cost of accompanying firesets. Small EFI sizes may in turn relieve design constraints on accompanying systems, such as missile systems, thereby reducing costs and enhancing performance of the entire systems.

Exact materials and dimensions of various components employed to implement embodiments discussed herein are application specific. Those skilled in the art with access to the present teachings may readily employ desired materials to meet the needs of a given application.

Although the invention has been discussed with respect to specific embodiments thereof, these embodiments are merely illustrative, and not restrictive, of the invention. In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow "a", an and "the" include plural references unless the context clearly dictates otherwise. Furthermore, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances, some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. An actuator assembly comprising:

a substrate;

a first electrode disposed on the substrate;

a second electrode disposed on the substrate;

a bridge coupled between the first electrode and the second electrode;

a lithographically disposed flyer in proximity to the bridge;

first means for activating the bridge via application of a signal to the first electrode and the second electrode;

a lithographically disposed barrel positioned in proximity to the lithographically disposed flyer, wherein the barrel includes tabs extending therefrom; and one or more grooves in the substrate to which the tabs are coupled.

2. An actuator assembly comprising:

a substrate;

a first electrode disposed on the substrate;

a second electrode disposed on the substrate;

a bridge coupled between the first electrode and the second electrode; and a lithographically disposed flyer in proximity to the bridge, wherein the flyer includes one or more holes therein.

3. The actuator assembly of claim 2 wherein the one or more holes are positioned in the flyer relative to the bridge so that activation of the bridge causes the flyer to impact energetic material in a substantially flat position.

4. The actuator assembly of claim 2 wherein the one or more holes are positioned in the flyer to affect a flight characteristic of the flyer.

5. The actuator assembly of claim 4 wherein the flight characteristic includes the flyer spinning or rotating in flight.

6. The actuator assembly of claim 1 wherein the bridge includes a pattern of plural thin or narrow regions, the pattern chosen to affect one or more flight characteristics or behaviors of the flyer.

7. The actuator assembly of claim 6 further including a first conductive pin and a second conductive pin extending through the substrate to the first electrode and the second electrode, respectively.

8. The actuator assembly of claim 1 further including an array of individual initiators representing instances of the actuator assembly.

9. An actuator assembly comprising:

a substrate;

a bridge coupled between a first electrode and a second electrode on the substrate; and a lithographically disposed flyer in proximity to the bridge, wherein the flyer includes means for flattening during flight; and a lithographically disposed barrel in proximity to the flyer.

10. The actuator assembly of claim 9 further including fireset coupled to pins extending through the substrate to the first electrode and the second electrode.

11. An actuator assembly comprising:

a substrate;

a bridge coupled between a first electrode and a second electrode on the substrate; and a lithographically disposed flyer in proximity to the bridge, wherein the flyer includes a three-dimensional surface that is concave, convex, or includes one or more protrusions therefrom; and a lithographically disposed barrel in proximity to the flyer.

12. The actuator assembly of claim 9 wherein the bridge has plural legs.

13. An actuator assembly comprising:

a substrate;

a bridge coupled between a first electrode and a second electrode on the substrate; and a lithographically disposed flyer in proximity to the bridge, wherein the flyer includes perforations therein; and a lithographically disposed barrel in proximity to the flyer.

14. The actuator assembly of claim 9 further including one or more strategically formed grooves in the substrate, wherein the one or more strategically formed grooves couple the lithographically formed barrel with the substrate.

15. The actuator assembly of claim 9 further including a three-dimensional surface formed on the substrate underlying the lithographically disposed flyer.

16. The actuator assembly of claim 9 wherein the substrate includes an insulating layer disposed thereon.

17. The actuator assembly of claim 9 wherein the substrate includes a PCB material.

18. The actuator assembly of claim 9 wherein the substrate includes a hardening layer or a smoothing layer disposed on the PCB material under the lithographically disposed flyer.

19. The actuator assembly of claim 9 further including an array of the actuator assemblies.

20. The actuator assembly of claim 9 wherein the actuator assembly is characterized by a response time less than 200 nanoseconds.

21. An actuator assembly comprising:

a substrate;

a bridge disposed on a three-dimensional surface on the substrate and coupled between a first electrode and a second electrode on the substrate; and a star-shaped flyer positioned on the bridge.

22. The actuator assembly of claim 21 further including a bridge with plural legs.

23. A method for using an actuator assembly, the method comprising:

generating a first signal in response to one or more predetermined conditions;

employing an exploding or expanding bridge to launch a lithographically formed flyer in a desired direction in response to the first signal, wherein the lithographically formed flyer is convex or concave, and further including a lithographically formed barrel partially surrounding the lithographically formed flyer, wherein the lithographically formed barrel includes one or more tabs extending therefrom; and generating a second signal in response to the first signal, wherein the one or more tabs are coupled to one or more grooves in a substrate upon which the lithographically formed barrel is disposed.

* * * * *